US005921536A

United States Patent [19]

Bernstein

[11] Patent Number: 5,921,536

[45] Date of Patent: Jul. 13, 1999

[54] REVERSIBLE TWO FACE JAW PLATE FOR VISE OR CLAMP

[75] Inventor: Leon M. Bernstein, Minnetonka, Minn.

[73] Assignee: Kurt Manufacturing Company, Inc., Fridley, Minn.

[21] Appl. No.: 08/892,257

[22] Filed: Jul. 11, 1997

[51] Int. Cl.[6] ..... B25B 1/24

[52] U.S. Cl. ..... 269/282; 269/283

[58] Field of Search ..... 403/335, 336, 403/354, 381, 375; 269/279–284

[56] References Cited

U.S. PATENT DOCUMENTS

| | | | |
|---|---|---|---|
| 2,088,320 | 7/1937 | De Vries | 403/381 |
| 3,451,158 | 6/1969 | Fischer | 403/381 |
| 3,837,754 | 9/1974 | Malcik | 403/375 |
| 4,098,500 | 7/1978 | Lenz . | |
| 4,291,870 | 9/1981 | Warde . | |
| 4,437,654 | 3/1984 | Chiappetti . | |
| 4,861,010 | 8/1989 | Neil . | |
| 4,898,371 | 2/1990 | Mills et al. . | |
| 5,078,372 | 1/1992 | Fitzpatrick | 269/282 |
| 5,242,159 | 9/1993 | Bernstein . | |
| 5,396,963 | 3/1995 | Curry | 403/381 |
| 5,433,416 | 7/1995 | Johnson | 403/381 |

FOREIGN PATENT DOCUMENTS

| | | | |
|---|---|---|---|
| 493 319 A2 | 7/1992 | European Pat. Off. | 403/381 |
| WO95/04228 | 2/1995 | WIPO | 403/381 |

*Primary Examiner*—Robert C. Watson
*Attorney, Agent, or Firm*—Westman, Champlin & Kelly, P.A.

[57] ABSTRACT

A reversible jaw plate for a clamping device, such as a machine vise, has two substantially parallel, oppositely facing clamping faces. At least one mounting slot is formed in the jaw plate that opens to one edge of the jaw plate. The mounting slot has a center wide portion and two narrower slot portions opening to the two faces of the jaw plate. A head of a fastener is slid into a wider portion of the slot with the shank of the fastener extending out one of the narrow slot portions, to extend from a first of the two faces of the jaw. The second, opposite face may be used for clamping. The jaw plate can be reversed so that the shank of the fastener extends from the narrower slot in the other of the jaw plate faces, to permit using the first face for clamping. Either one of the jaw plate faces can be used for clamping a workpiece by reversing the jaw plate and having a reversible fastener in the mounting slot or slots to secure the jaw plate to a jaw or mounting member.

6 Claims, 2 Drawing Sheets

REVERSIBLE TWO FACE JAW PLATE FOR VISE OR CLAMP

BACKGROUND OF THE INVENTION

The present invention relates to a two face jaw plate for a vise or clamp which is reversible, so that both sides or faces of the jaw plate can be selectively used as a clamping surface. The jaw plate is quickly removable and replaceable.

In the prior art, various jaw plates for vises and other clamps have been advanced which are quickly removable, using various securing techniques. However, the jaw plates that exist are made so that only one surface can be used for clamping because of the arrangement of the fasteners that hold the jaw plate in position. This limits the use of the jaw plates, and leads to greater inventory needs.

SUMMARY OF THE INVENTION

The present invention relates to a two face reversible jaw plate which is quickly attached to a jaw of a vise or a clamp, utilizing fasteners that can be loosened so that the jaw plate can be slipped into place. The jaw plate has a centered wide slot that will receive the head of a fastener, such as a pull rod or cap screw, and has smaller width slots on both sides of the center slot opening to the respective outer faces of the jaw plate. This means that the head of a fastener can be slipped into the centered wide slot in the jaw plate and oriented to extend out in either direction so that either one of two faces can be selected for clamping an object.

The jaw plates thus are very versatile, and can quickly be reversed. One of the faces can have a step or shoulder in it for holding workpieces, while the other one face can be a planar surface across the entire area, if desired.

DETAILED DESCRIPTION OF THE PREFERRED EMBODIMENTS

Figure 1:
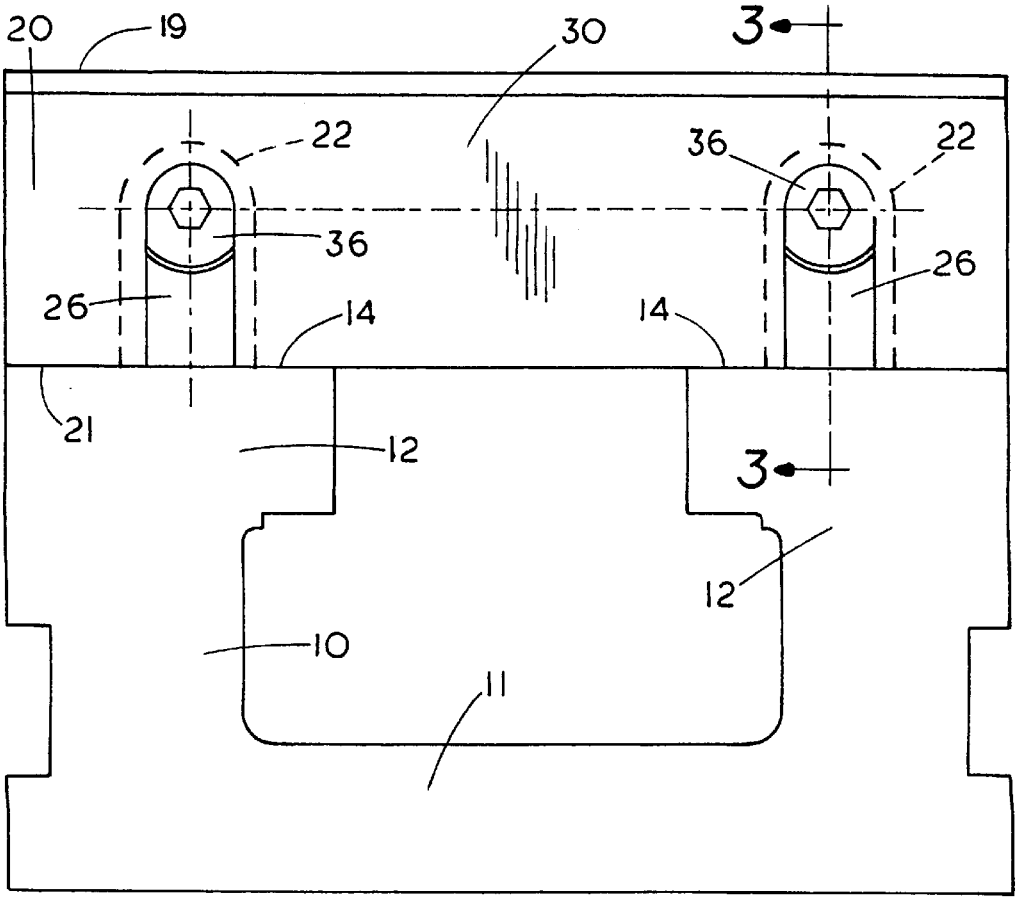
FIG. 1 is an end view of a machine vise showing a jaw of a vise having a two face jaw plate made according to the present invention installed thereon.

A conventional vise 10 has a vise base 11 supporting a pair of spaced side rails 12, 12 that have upper surfaces 14 that support vise jaws. There are generally two vise jaws spaced along the frame 10, one of which would be movable. In the form shown, a fixed jaw 16 is mounted on the rails 12 in a suitable manner, and it is to be understood that a movable jaw also would be used. Various vises that utilize movable jaws are known, including that shown in U.S. Pat. No. 4,098,500.

In the present invention, a quick change, two face removable jaw plate 20 is utilized. Jaw plate 20 has a rectangular periphery and has top and bottom edges 19 and 21. A central, wide, closed end slot portion 22 is formed in two laterally spaced positions on the jaw plate. The wide slot portions 22 both open to the bottom edge 21 of the jaw plate. In addition to the wide slot portion 22 there are narrower slot portions 26 and 28 opening to the opposite jaw faces 30 and 32 at each of the wide slot portions. The narrower slot portions 26 and 28 also open to the bottom edge 21 of the jaw plate.

Figure 2:
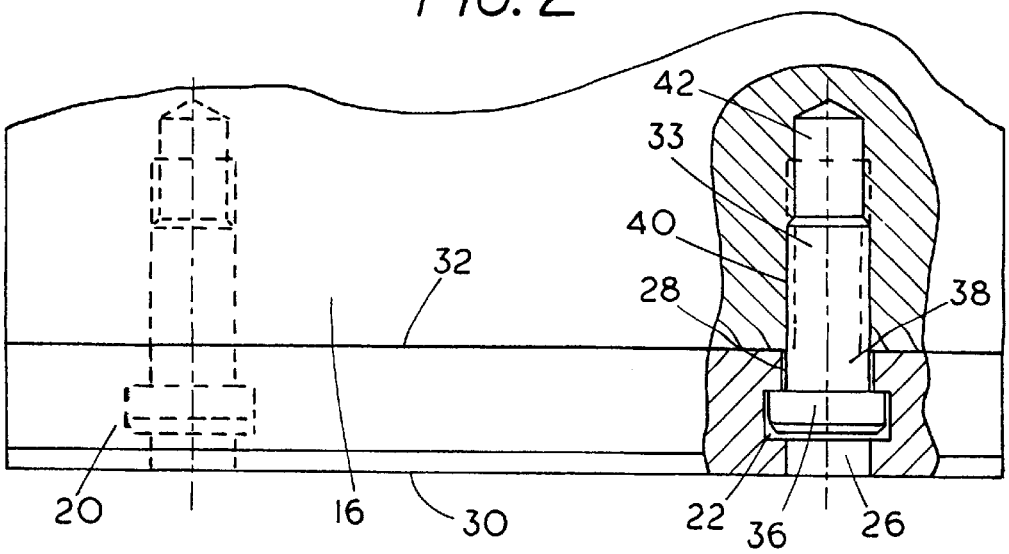
FIG. 2 is a top plan view of the two face jaw plate of FIG. 1 with parts broken away to illustrate a typical fastener.
Figure 3:
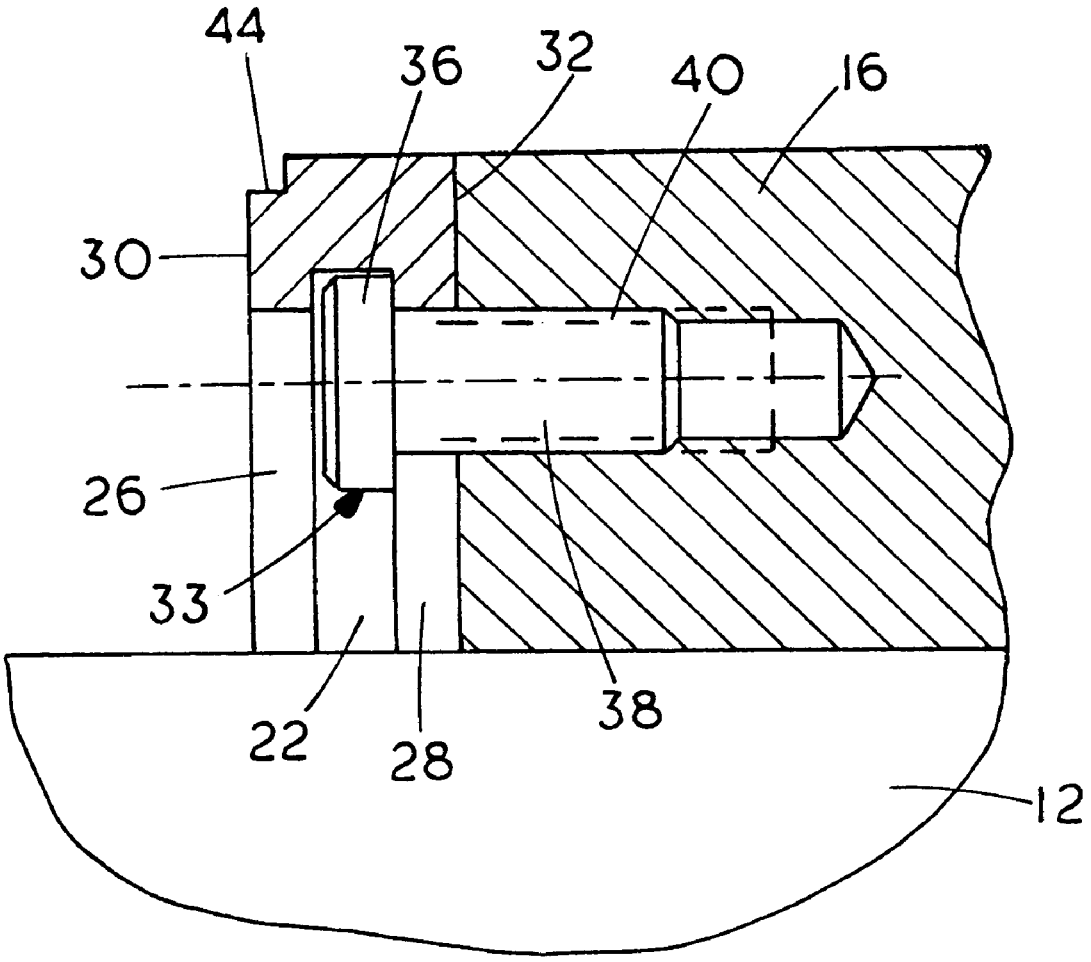
FIG. 3 is a sectional view as taken as on line 3—3 in FIG. 1.

A typical headed fastener 33, which also can be called a pull rod, has a head 36 which slips into the wide slot portion 22. The fastener 33 has a shank 38, which slides through the narrower slot portions 26 or 28. As shown in FIG. 2, the jaw plate face 32 is clamped against the jaw 16, so the fastener or rod shank 38 passes through the narrower slot portion 28. As shown, the fastener 33 has a threaded section 40 that threads into suitable interior threads in a bore 42 in the jaw 16 of the vise. The fastener can be locked in position by a cam on the jaw 16 or other types of tightening devices.

As can be seen, there are two of the slots 22 spaced across the width of the jaw. The fasteners 33 shown can be quickly loosened and tightened by use of an Allen wrench that is inserted through the open narrow slot portions 26, when the fasteners are extending out through slot portions 28.

If desired, the face 30 can have a shoulder 44 formed at the upper edge, while the face 32 is continuous across the rectangular configuration of the jaw plate.

The jaw plate thus can be loosened from the jaw 16 by loosening the fasteners 33. The jaw plate can be released from the heads 36 by lifting it. The jaw plate can be quickly reversed so that the surface 30 is against the jaw 16, and the surface 32 is available for clamping relative to a movable jaw, as is known.

The fastener 33 can have a head 36 that is low profile for fitting into the slot portion 22, and thus the thickness of the jaw plate does not have to vary from the existing sizes.

Although the present invention has been described with reference to preferred embodiments, workers skilled in the art will recognize that changes may be made in form and detail without departing from the spirit and scope of the invention.

What is claimed is:

1. A jaw plate for a clamping device having a jaw member comprising:

a flat solid plate having a thickness between opposite jaw faces bounded by top, bottom and side edges, the top and bottom edges being substantially longer than the side edges, at least one mounting slot formed in the flat plate and opening to the bottom edge, said mounting slot including a wide slot portion substantially centered on the thickness of the flat plate, and having narrower slot portions extending from the wide slot portion, toward each of the opposite faces, and being open to the faces, said slot portions all opening to the bottom edge of the jaw plate, such that a head of a fastener slides into the wide slot portion, with a shank of the fastener extending through one of the slot narrower portions, such that the fastener may extend from either of the jaw faces.

2. The jaw plate of claim 1, wherein said narrower slot portions are centered on a center line of the wide slot portion and are substantially identical in size but opening to opposite faces of the jaw plate.

3. The jaw plate of claim 1, wherein there are two wide slot portions spaced along a length of the jaw, each of said wider slot portions having a pair of oppositely directed narrow slot portions opening thereto for permitting a head of a fastener to fit into each of the wider slot portions with a shank of said fastener passing through a selected one of the two narrow slot portions.

4. A jaw plate comprising:

a solid plate having peripheral edges defining a length and a height and the plate member having a thickness, the plate having two oppositely facing jaw faces;

a pair of slots formed through the jaw plate and both slots opening to one of the edges along the length only, said slots being spaced apart along the lengths and each slot being symmetrical in both directions toward the two faces from a center plane substantially parallel to the two faces and substantially midway between the two faces, each said slot being configured to be wider in a center portion of the plate to receive a head of a fastener, and having narrower openings from the center portion to the opposite faces, such that shank portions of the fastener can pass out of the jaw plate selectively to extend from either of the two faces of the jaw plate, such that the jaw plate may be clamped in a position by such fastener with either of the faces held securely against a jaw of a clamping member.

5. The jaw plate of claim 4, wherein the length of the solid plate member is substantially greater than the height and thickness.

6. The jaw plate of claim 4, wherein both of said slots open to the same longitudinal edge, such that the wider, center portions and the narrower portions provide a slot that can be slid over the heads of fasteners with shanks of the fasteners passing through the narrower portions.

* * * * *